United States Patent [19]

Chryssomallis et al.

[11] Patent Number: 4,895,062

[45] Date of Patent: Jan. 23, 1990

[54] COMBUSTION AUGMENTED PLASMA GUN

[75] Inventors: George S. Chryssomallis, Golden Valley; Chris S. Sorenson, Edina; Stephen F. Mulich, Jr., Blaine; Charalampos D. Marinos, Brooklyn Park, all of Minn.

[73] Assignee: FMC Corporation, Chicago, Ill.

[21] Appl. No.: 182,683

[22] Filed: Apr. 18, 1988

[51] Int. Cl.[4] ..... F41F 1/04

[52] U.S. Cl. ..... 89/7; 89/8; 102/440

[58] Field of Search ..... 89/7, 8; 102/435, 440, 102/443

[56] References Cited

U.S. PATENT DOCUMENTS 4,352,397 10/1982 Christopher ..... 149/44
4,711,154 12/1987 Chryssomallis et al. ..... 89/7
4,715,261 12/1987 Goldstein et al. ..... 89/8

FOREIGN PATENT DOCUMENTS 2622156 11/1977 Fed. Rep. of Germany ..... 102/440

*Primary Examiner*—Stephen C. Bentley
*Attorney, Agent, or Firm*—Lloyd B. Guernsey

[57] ABSTRACT

Apparatus for providing a controlled increase in muzzle velocity of a projectile while reducing peak value of gas pressure inside a gun barrel. A cartridge includes an elongated body having a central bore divided into three chambers, with a fuel chamber separated from an oxidizer chamber and an elongated capillary chamber by a plurality of membranes. A fuse wire and a power supply vaporize a plasma base in the capillary chamber and provide a controlled jet to provide combustion between a second fuel in the fuel chamber and an oxidizer material in the oxidizer chamber. The power supply controls the fuel-oxidizer combustion rate to obtain a relatively steady pressure of long duration against the projectile which results in high projectile velocity with relatively low peak values of pressure in the gun barrel.

14 Claims, 5 Drawing Sheets

FIG_2
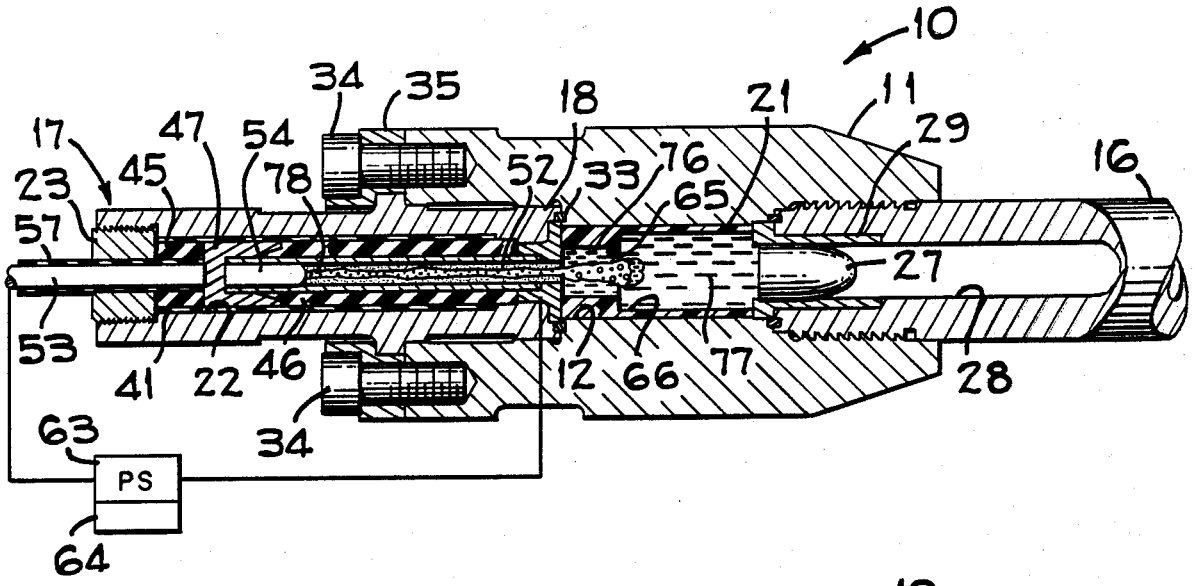
FIG_3
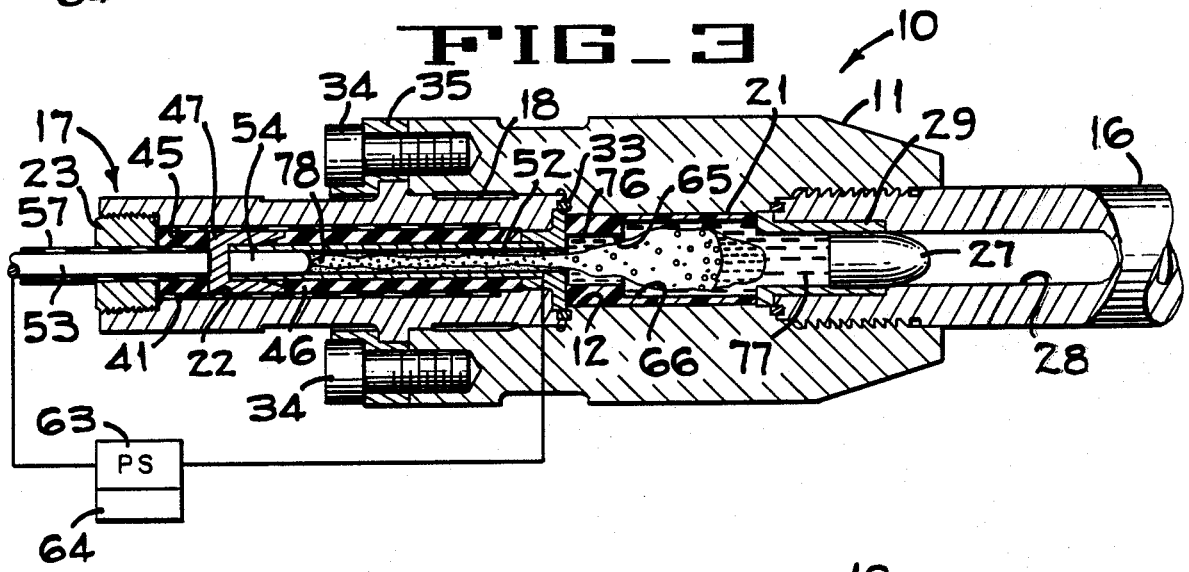
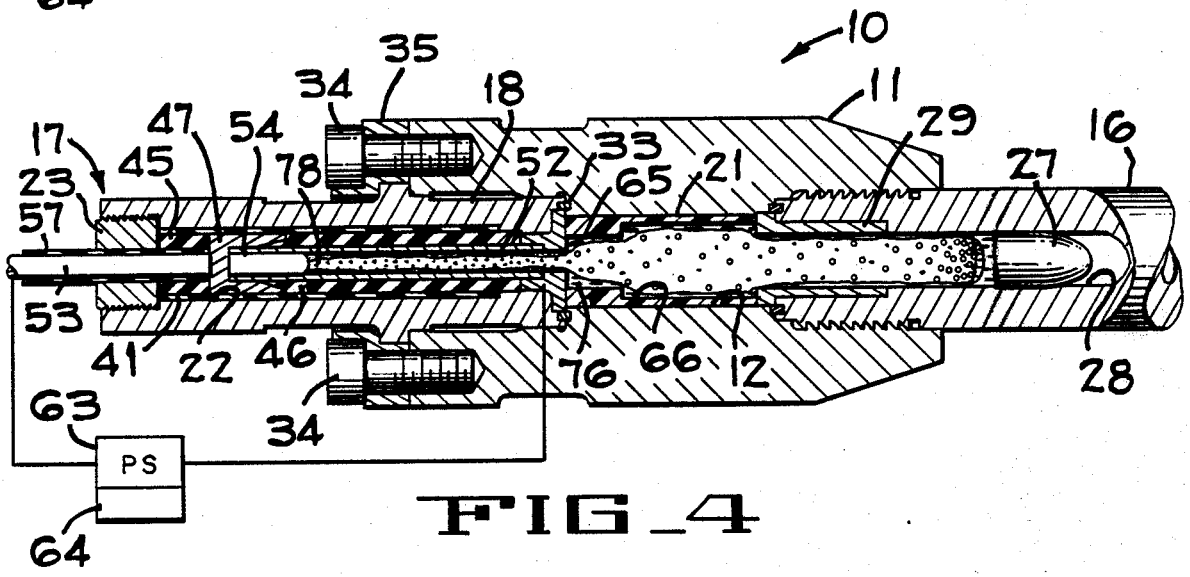
FIG_4

COMBUSTION AUGMENTED PLASMA GUN

BACKGROUND OF THE INVENTION

The present invention pertains to apparatus for controlled combustion in a gun, and more particularly, to apparatus for providing a controlled increase in muzzle velocity of a projectile while reducing the peak value of pressure inside a gun barrel.

Guns traditionally include an elongated barrel having a central bore closed at a breech end and having a projectile which is moved through the bore by heated gasses from a burning powder or liquid fired by an igniter. A burning powder produces a relatively high pressure against the projectile when the powder is initially ignited, with the pressure decreasing as the projectile moves along the gun barrel. Liquid fuel can be used to provide a more even pressure as the projectile moves along the gun barrel, but requires a critical fuel chamber size, bore diameter and manner of ignition of the fuel.

SUMMARY OF THE INVENTION

The present invention includes a gun cartridge having a capillary chamber, a fuel chamber and an oxidizer chamber. The chambers are aligned with the fuel chamber between the oxidizer chamber and the capillary chamber. When the cartridge is in a gun barrel an electric power supply heats and explodes a fuse wire inside the capillary chamber to vaporize a portion of a plasma base in the capillary chamber. The vaporized plasma base provides a narrow jet of ionized gas which vaporizes and entrains a portion of the fuel and causes the fuel to combine with a portion of an oxidizer material. The power supply continues to supply energy which controls the rate of vaporization of the plasma base and thus controls the rate of combustion of the oxidizer material and the fuel. Portions of the oxidizer material and fuel are launched and travel behind the projectile. Combustion of the traveling liquid phase occurs behind the projectile during the time it takes the projectile to move a maximum of 20 bore diameters along the gun barrel. The combustion energy released by the traveling liquid causes pressure against the projectile to remain relatively constant as the projectile moves along the length of the gun barrel. This allows the breech and chamber pressures to be relatively low and still provide a high velocity projectile at the gun nuzzle.

BRIEF DESCRIPTION OF THE DRAWINGS

FIGS. 2–4 disclose a sequence of operation of the apparatus of FIG. 1.

DESCRIPTION OF THE PREFERRED EMBODIMENT

Figure 1:
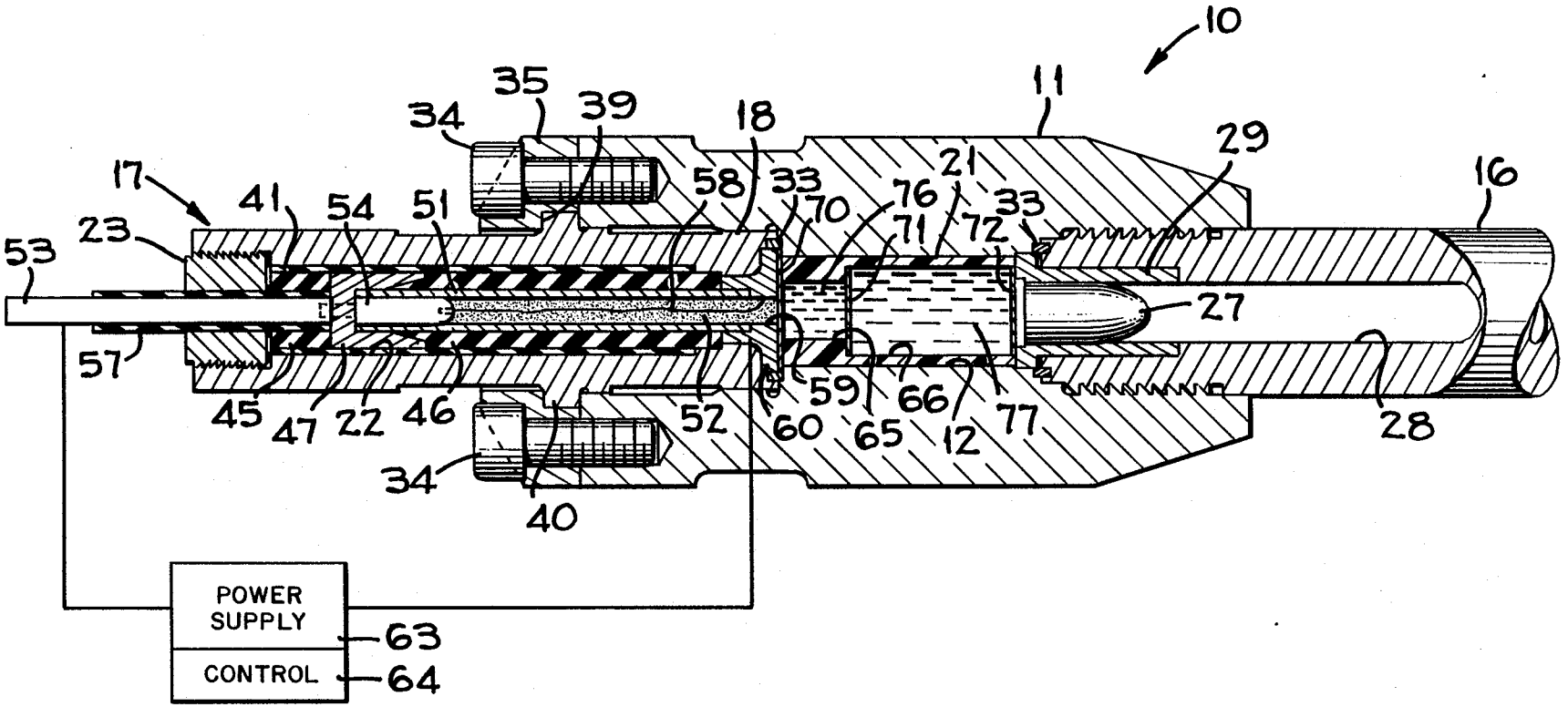
FIG. 1 is a cross sectional view of a combustion augmented plasma gun and cartridge of the present invention.

The combustion augmented plasma gun disclosed in FIG. 1 includes a gun 10 having a coupling block 11 with a cartridge chamber 12 extending through block 11. A gun barrel 16 is threaded into one end of block 11 and a cartridge 17 is mounted in the other end of coupling block 11. Cartridge 17 includes a metal body 18 and a plastic chamber back liner 21 with an elongated bore 22 extending lengthwise through the center of cartridge 17. A breech bolt 23 is threaded into a rear end of cartridge 17 and a projectile 27 is positioned at the other end of cartridge 17 in a bore 28 of gun barrel 16. Projectile 27 can be attached to the end of cartridge 17 or projectile 27 can be inserted separately into the position shown. A replaceable shot start bushing 29 mounted in bore 28 is adjacent to projectile 27. A pair of crush seals 33 provide sealing between coupling block 11, and barrel 16 and metal body 18. A plurality of breech ring bolts 34 secure a breech ring 35 to coupling block 11. A shoulder 39 on the breech ring 35 rests against a flange 40 on body 18 to selectively secure cartridge 17 in coupling block 11.

A hollow cylindrical outer insulator 41 lines a portion of bore 22 of cartridge 17. A ceramic insulator thrust collar 45 and a capillary backup insulator 46 are positioned inside insulator 41. An anode holder 47 is mounted between thrust collar 45 and insulator 46. A hollow capillary liner 51 mounted inside insulator 46 is filled with a plasma base in the form of a solid first fuel 52. A copper anode 53 extends through an anode insulator sleeve 57 and a copper anode holder. A copper/tungsten anode tip 54 threads into the anode holder 47 and extends into a rear portion of capillary liner 51. A fuse wire 58 connected to anode tip 54 extends through fuel 52 in a capillary chamber 59 to a copper/tungsten cathode 60 mounted inside cartridge body 18. A power supply 63 having a control 64 is connected between anode 53 and cathode 60 to provide electrical power to fuse wire 58 and fuel 52. Chamber back liner 21 is divided into a fuel chamber 65 and an oxidizer chamber 66 by a plurality of membranes 70–72. A second fuel 76 is stored in fuel chamber 65 and an oxidizer material 77 is stored in adjacent chamber 66. Fuel 76 is preferably a liquid hydrocarbon, such as kerosene, and oxidizer material 77 is a liquid, such as hydrogen peroxide. A number of liquid fuels and liquid oxidizer materials are suitable for use in the present invention. Criterion for choosing fuels and oxidizer material combinations include stability, toxicity, corrosion properties, energy density, chemical compatibilities, and physical properties such as mass, density, melting point, boiling point, viscosity and mistability. Other considerations are availability and cost.

Figure 5:
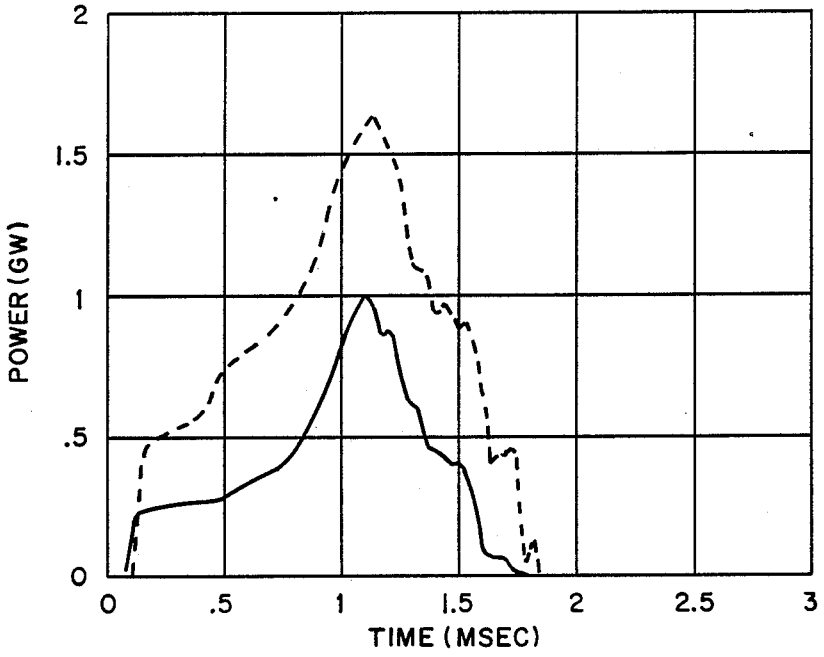
FIG. 5 discloses an electrical power pulse (in the solid line) which is needed to create a plasma in the capillary chamber and (in the dashed line) the resulting chemical pulse produced by combustion of the oxidizer material and fuel.
Figure 6:
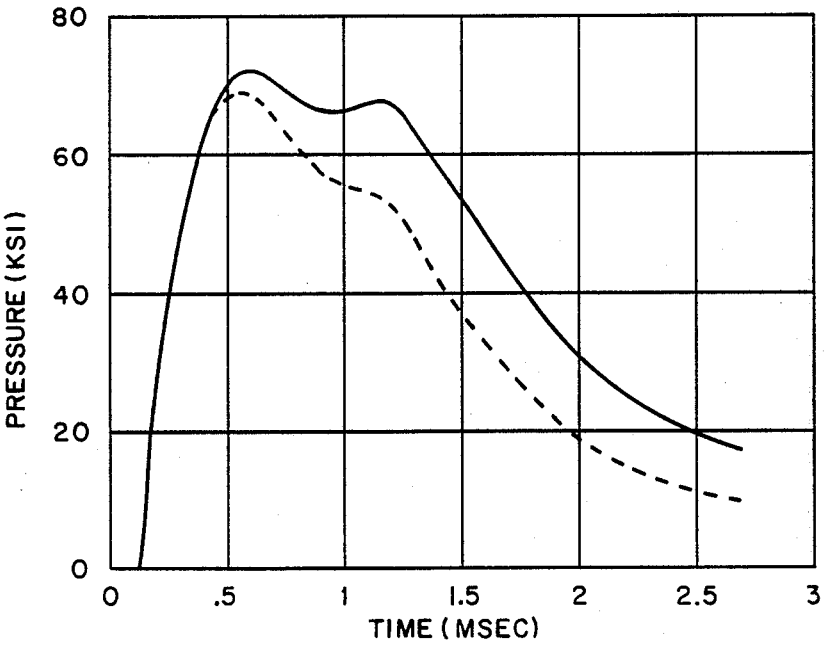
FIG. 6 discloses the breech pressure (in the solid line) and the projectile base pressure (in the dashed line) for a specific example of a 30 mm diameter gun having a barrel 2.67 m in length.
Figure 7:
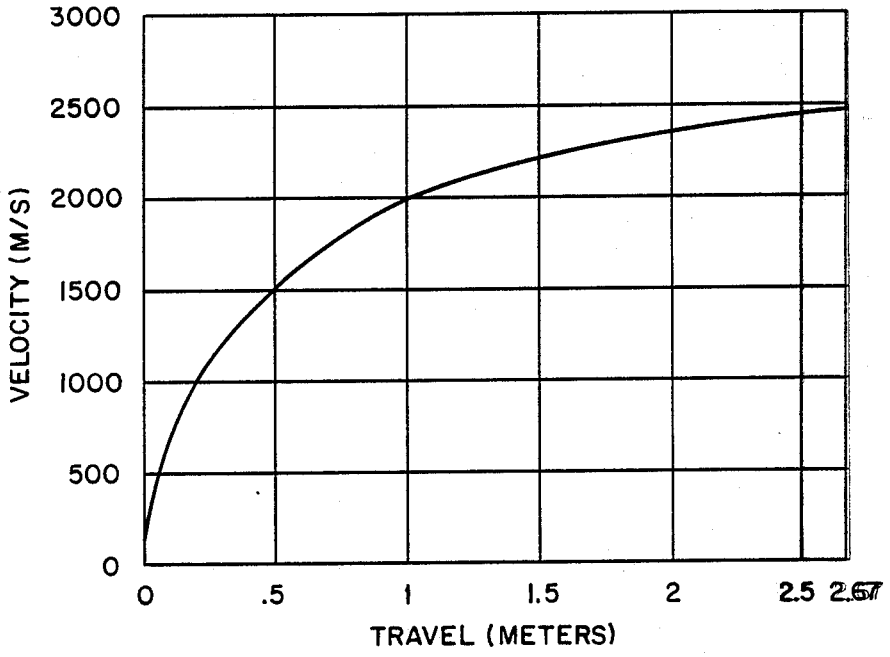
FIG. 7 discloses the velocity of a 50gm projectile as it travels along the barrel of a 30 mm gun.

To fire gun 10, control 64 (FIGS. 1–4) causes power supply 63 to provide electrical power as shown in the solid line graph of FIG. 5 which shows power vs. time. Power supply 63 causes fuse wire 58 to heat fuel 52 and produce a plasma of ionized gas containing both positive and negative ions so the gas is rendered conductive. The fuse wire quickly vaporizes to produce a plasma with gas ions which maintain an electrical current path through fuel 52 in capillary chamber 59. Current through the fuel 52 produces a narrow jet 78 (FIG. 2) of ionized gas and molten particles which punches a hole in first membrane 70, through fuel 76, second membrane 71 and oxidizer material 77. A portion of fuel 76 is quickly launched and mixed with oxidizer material 77 while additional fuel is more slowly aspirated into the fast flowing gas stream in the form of small droplets. The small droplets evaporate and decompose quickly enriching the jet with fuel. A similar process follows in the oxidizer chamber with a portion of the liquid oxidizer material and some fuel following the projectile 27 as it travels down the gun barrel as shown sequentially in FIGS. 2–4. The remainder of the oxidizer material is aspirated in the fuel rich gas where the oxidizer material reacts with the fuel, releasing combustion byproducts and heat, the released heat contributes in generating and sustaining pressure against the moving projectile. A portion of the moving fuel and oxidizer material is left as a thin film on the walls of the bore 28 of barrel 16 and droplets also fall from the rear portion of the moving fuel and oxidizer material. These droplets and film evaporate into the gas jet enriching it with reactive components. This combustion continues to provide added pressure on the rear portion of projectile 27.

The amount of film which covers the walls of the bore of the barrel and the amount of fluid which follows the projectile can be controlled by tuning the diameters of the capillary, fuel and oxidizer chambers and gun barrel. The thin film of liquid which covers the walls of bore 28 absorbs a great amount of heat to evaporate, thus protecting the walls of the bore from scorching heat and improving the life of the gun barrel. The traveling charge enhances pressure against the base of the projectile to produce more thrust and improve performance.

ALTERNATE EMBODIMENTS OF THE INVENTION

Figure 8:
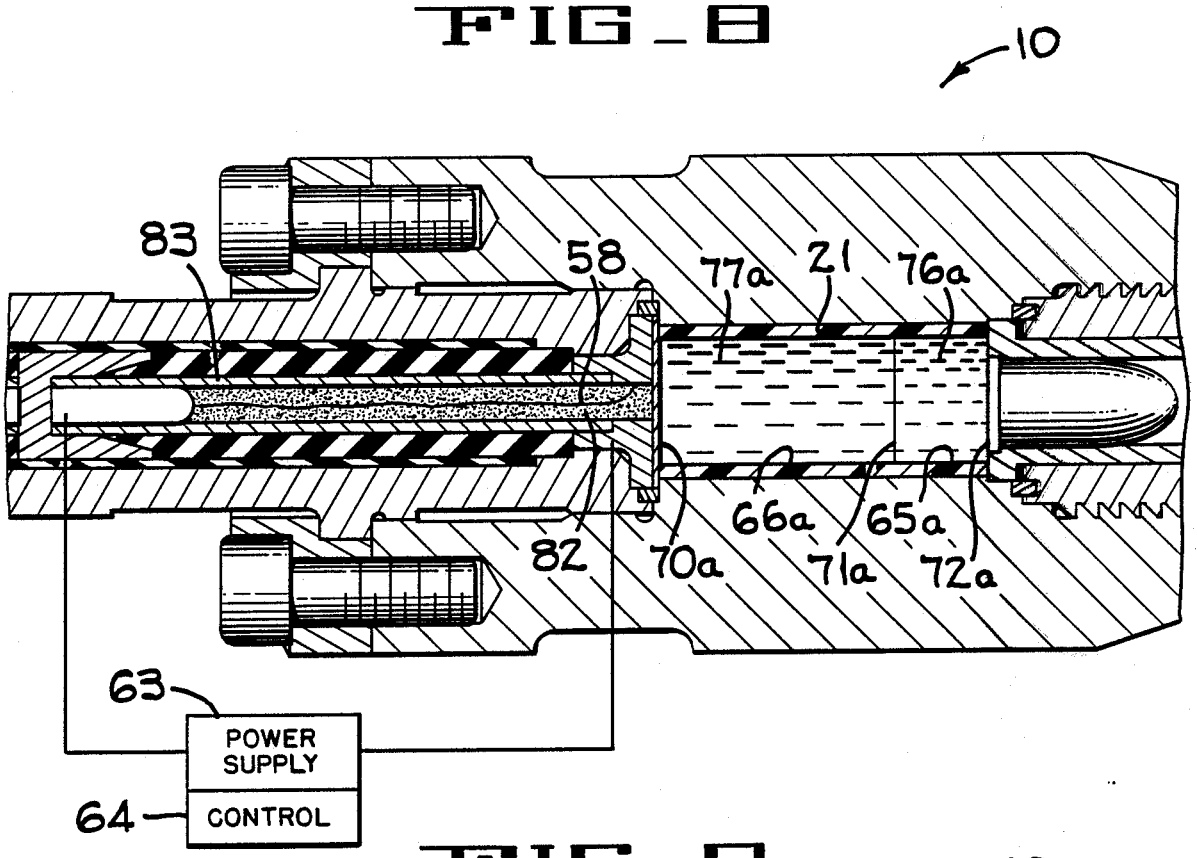
FIG. 8 discloses another embodiment of the combustion augmented plasma gun and cartridge of the present invention.
Figure 9:
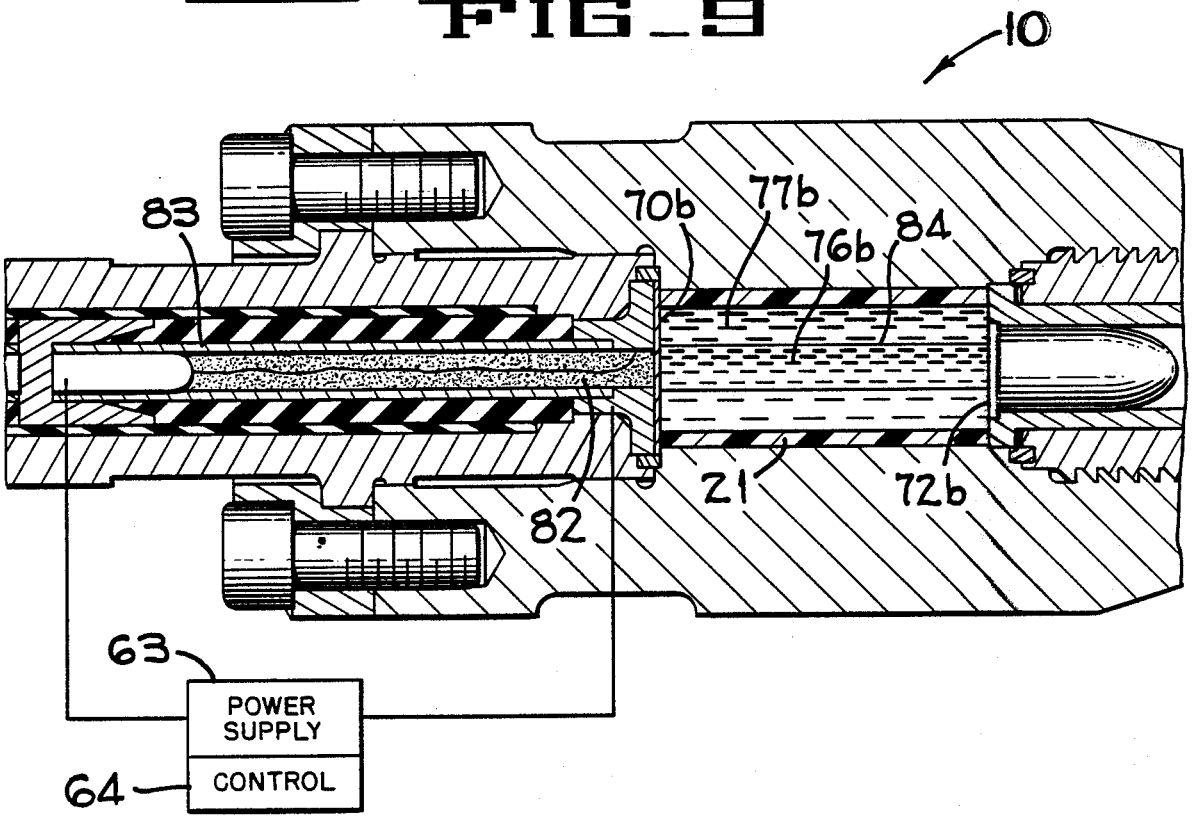
FIG. 9 discloses still another embodiment of the combustion augmented plasma gun and cartridge of the present invention.

FIGS. 8 and 9 disclose alternate embodiments of the present invention in which a plasma base for generating a primary plasma can be either a fuel or an oxidizer material. The plasma base (FIG. 8) includes a powder 82 enclosed in a solid material 83. One plasma base combination which can be used is a powder 82 of ammonium nitrate and a solid material 83 of compression compacted ammonium nitrate. Several other combinations of fuels and combinations of oxidizer materials can also be used as a plasma base. Chamber back liner 21 is divided into a fuel chamber **65*a* and an oxidizer chamber 66*a* by a plurality of membranes 70*a*–72*a*. A liquid oxidizer material 77*a* is stored in oxidizer chamber 66*a* and a liquid fuel 76*a* is stored in adjacent chamber 65*a***.

Control 64 (FIG. 8) and power supply 63 provide electrical power which causes fuse wire 58 to vaporize and produce an ion path through the powder plasma base 82. Powder 82 and solid material produce a narrow jet of ionized gas with molten particles which punch a hole in membrane **70*a*, through oxidizer material 77*a*, membrane 71*a* and fuel 76*a*** as described above.

A further embodiment of the present invention, disclosed in FIG. 9, includes the plasma base consisting of powder 82 and solid material 83 as described in FIG. 8. A liquid fuel **76*b* in a cylindrical plastic container 84 is surrounded by an oxidizer material 77*b* and enclosed in chamber back liner 21 with end membranes 70*b*, 72*b***.

Although the best mode contemplated for carrying out the present invention has been herein shown and described, it will be apparent that modification and variation may be made without departing from what is regarded to be the subject matter of the invention.

What is claimed is:

1. A combustion augmented plasma propulsion apparatus for use in projecting a projectile comprising:

a cartridge having a capillary chamber, a fuel chamber and an oxidizer chamber;

a plurality of membranes mounted between said chambers;

a plasma base mounted in said capillary chamber;

an anode mounted adjacent to a first end portion of said capillary chamber;

a cathode mounted adjacent to a second end portion of said capillary chamber;

a fuse wire mounted in said capillary chamber between said anode and said cathode for ignition of said plasma base;

a fuel mounted in said fuel chamber;

an oxidizer material mounted in said oxidizer chamber;

means for providing electrical power between said anode and said cathode to cause said fuse wire to ignite a portion of said plasma base; and means for providing a controlled amount of electrical power to said plasma base in said capillary chamber to control a rate of burning of said plasma base and thereby control a rate of combustion of said fuel and of said oxidizer material.

2. A combustion augmented plasma propulsion apparatus as defined in claim 1 wherein said capillary chamber, said fuel chamber and said oxidizer chamber are aligned with said oxidizer chamber between said capillary chamber and said fuel chamber.

3. A combustion augmented plasma propulsion apparatus as defined in claim 1 wherein said fuel chamber is adjacent to said capillary chamber to cause said burning plasma base to induce combustion of said fuel, and wherein said oxidizer chamber surrounds said fuel chamber so combustion of said fuel causes combustion of said oxidizer material.

4. A combustion augmented plasma propulsion apparatus for use in projecting a projectile comprising:

a cartridge having a capillary chamber, a fuel chamber an an oxidizer chamber, said chambers being aligned, with said fuel chamber between said capillary chamber and said oxidizer chamber;

a first fuel mounted in said capillary chamber;

an anode mounted adjacent to a first end portion of said capillary chamber;

a cathode mounted adjacent to a second end portion of said capillary chamber;

a fuse wire mounted in said capillary chamber between said anode and said cathode for ignition of said first fuel;

a second fuel mounted in said fuel chamber;

an oxidizer material mounted in said oxidizer chamber;

means for providing electrical power between said anode and said cathode to cause said fuse wire to ignite a portion of said first fuel; and means for providing a controlled amount of electrical power to said capillary chamber to control a rate of burning of said first fuel to thereby control a rate of combustion of said second fuel and of said oxidizer material.

5. A combustion augmented plasma propulsion apparatus as defined in claim 4 wherein said first fuel is a solid and said second fuel is a liquid.

6. A combustion augmented plasma propulsion apparatus as defined in claim 4 wherein said capillary chamber has a length much greater than a diameter.

7. A combustion augmented plasma propulsion apparatus as defined in claim 4 including a projectile mounted adjacent to said oxidizer chamber.

8. A combustion augmented plasma propulsion apparatus as defined in claim 4 including a pair of membranes, a first membrane being interposed between said first and said second fuel chambers, a second membrane being interposed between said second fuel chamber and said oxidizer chamber.

9. A gun system having a source of electrical energy and a gun having a receiver and a barrel with a cartridge chamber, said system including:

a cartridge having an outer housing with a bore extending longitudinally through said housing;

membrane means for dividing said cartridge bore into first, second and third chambers with said second chamber between said first and said third chambers;

a first fuel mounting in said first chamber;

an anode mounted adjacent to a first end portion of said first chamber;

a cathode mounted adjacent to a second end portion of said first chamber;

a fuse wire extending through said first chamber for connection between said anode and said cathode;

an electrical source for igniting said first fuel;

means for connecting said electrical source between said anode and said cathode;

a second fuel mounted in said second chamber;

an oxidizer material mounted in said third chamber; and means for providing a controlled amount of electrical power to said anode and said cathode adjacent to said first chamber to control a rate of burning of said first fuel to thereby control a rate of combustion of said second fuel and of said oxidizer material.

10. A gun system as defined in claim 9 including an anode and a cathode, said anode being mounted at a first end of said first chamber and said cathode being mounted at a second end of said first chamber, and means for connecting said electrical source to said anode and said cathode to provide electrical power to ionize a controlled portion of said first fuel.

11. A gun system as defined in claim 10 including means for controlling the amount of electrical power to cause said fuse wire to ignite said first fuel and for controlling the amount of electrical power to ionize said first fuel.

12. A gun system as defined in claim 9 wherein a diameter of said first chamber is relatively small compared to a length of said first chamber.

13. A gun system as defined in claim 9 wherein a diameter of said second chamber and a diameter of said third chamber are larger than a diameter of said first chamber.

14. A gun system as defined in claim 9 including a projectile mounted adjacent to said third chamber.

* * * * *